US007119694B2

(12) United States Patent
Ehlers

(10) Patent No.: US 7,119,694 B2
(45) **Date of Patent: *Oct. 10, 2006**

(54) PROXIMITY DEAD MAN INTERRUPTER, ALARM AND REPORTING SYSTEM

(76) Inventor: Gregory Ehlers, 710 Bent Grass Ct., Dacula, GA (US) 30019

( * ) Notice: Subject to any disclaimer, the term of this patent is extended or adjusted under 35 U.S.C. 154(b) by 0 days.

This patent is subject to a terminal disclaimer.

(21) Appl. No.: 11/345,116

(22) Filed: Feb. 1, 2006

(65) Prior Publication Data

US 2006/0145877 A1 Jul. 6, 2006

Related U.S. Application Data

(63) Continuation of application No. 10/674,621, filed on Sep. 30, 2003, now Pat. No. 7,034,696.

(60) Provisional application No. 60/469,802, filed on May 9, 2003.

(51) Int. Cl.
*G08B 23/00* (2006.01)

(52) U.S. Cl. ..... 340/573.3; 340/573.5; 340/539.11; 340/539.22

(58) Field of Classification Search ..... 340/506, 340/509, 539.11, 539.13, 539.15, 539.19, 340/539.22, 539.23, 573.1, 573.5, 573.7, 340/686.1, 686.6, 989; 600/509, 520, 523; 482/4, 8, 99

See application file for complete search history.

(56) References Cited

U.S. PATENT DOCUMENTS

| | | | | |
|---|---|---|---|---|
| 4,746,113 | A | 5/1988 | Kissel | |
| 4,932,910 | A | 6/1990 | Hayday | |
| 5,408,238 | A | 4/1995 | Smith | |
| 5,742,233 | A | 4/1998 | Hoffman et al. | |
| 5,913,827 | A | 6/1999 | Gorman | |
| 6,100,806 | A | 8/2000 | Gaukel | |
| 6,160,481 | A | 12/2000 | Taylor, Jr. | |
| 6,332,094 | B1 * | 12/2001 | Gorman | 600/520 |
| 6,405,077 | B1 * | 6/2002 | Birnbaum et al. | 600/520 |
| 6,464,618 | B1 * | 10/2002 | Shea | 482/8 |
| 6,529,131 | B1 | 3/2003 | Wentworth | |
| 6,545,606 | B1 | 4/2003 | Piri | |
| 6,624,754 | B1 | 9/2003 | Hoffman et al. | |
| 6,736,759 | B1 | 5/2004 | Stubbs et al. | |
| 7,034,696 | B1 * | 4/2006 | Ehlers | 340/573.7 |

* cited by examiner

*Primary Examiner*—Van T. Trieu
(74) *Attorney, Agent, or Firm*—Howard & Howard Attorneys, P.C.

(57) ABSTRACT

A system for controlling operation of a machine or process includes a control point and a remote node. The control point is located with respect to the machine or process. The remote node is located with respect to an operator of the machine or process for detecting a predetermined condition of the operator and responsively delivering a fault signal to the control point through a wireless communications channel.

36 Claims, 2 Drawing Sheets

PROXIMITY DEAD MAN INTERRUPTER, ALARM AND REPORTING SYSTEM

This application is a continuing of U.S. application Ser. No. 10/674,621, filed on 30 Sep. 2003, and now U.S. Pat. No. 7,034,696.

FIELD OF THE INVENTION

The present invention relates generally to safety switches, and more particularly, to a switch for interruption operation of a machine and an alarm and reporting system.

BACKGROUND OF THE INVENTION

Dead man switches have been in use for many years. They were originally associated with industrial and commercial equipment and processes to avoid injury or loss of life should the operator loose control of the equipment for any reason. Their use has grown widely over the past 35 years due to increased government regulation and oversight by organizations such as OSHA, consumer protection organizations like those formed by Ralph Nader, Labor Organizations and Insurance Companies to name a few. In addition, with the growing litigation related to consumer product induced injuries, safety and safe guards have become commonplace in most products. In the area of recreational vehicles and watercraft such devices have become commonplace. Many jet ski's, snow mobiles, all terrain vehicles and even fishing boats come equipped with dead man switch devices to ensure that the craft or vehicle will either stop or assume an idle state should the switch be engaged. These dead man devices or mechanisms come in many forms. Some are spring loaded throttles, which assume an idle state if not being held in place by the hand or foot of the operator. Others are switch mechanisms, which have a tether or cord associated with them that are attached to the operator. If the operator should fall off or be thrown from the normal operators station, the tether would cause the switch to be activated thus interrupting the ignition of the craft or vehicle causing it to stop.

All of these safety devices perform well and have avoided needless injuries and deaths. They are however sometimes misused and therefore cannot perform their proposed function. A tethered dead man ignition interrupter on a high-powered speedboat can only perform its intended function if the operator attaches it to their person. Many times however, such devices cause undue restriction of movement or just simply become a nuisance to deal with and are unintentionally ignored thus allowing the operator to put themselves and others in potential danger. The proposed invention is designed to overcome the inconveniences associated with many dead man-switching devices while providing the same or better safety and protection features of it predecessors.

SUMMARY OF THE INVENTION

In one aspect of the present invention, a system for controlling operation of one of a machine and process is provided. The system includes a control point located with respect to the one of a machine and process and a remote node located with respect to an operator of the one of a machine and process. The remote node detects a predetermined condition of the operator and responsively delivers a fault signal to the control point through a wireless communications channel.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

With reference to the Figures and in operation, the present invention provides a system 10 for controlling operation of one of a machine or process 12. For example, the machine 12 could be a marine vehicle, such as a boat or ship, or an agricultural machine. The process could be a manufacturing process.

Figure 1:
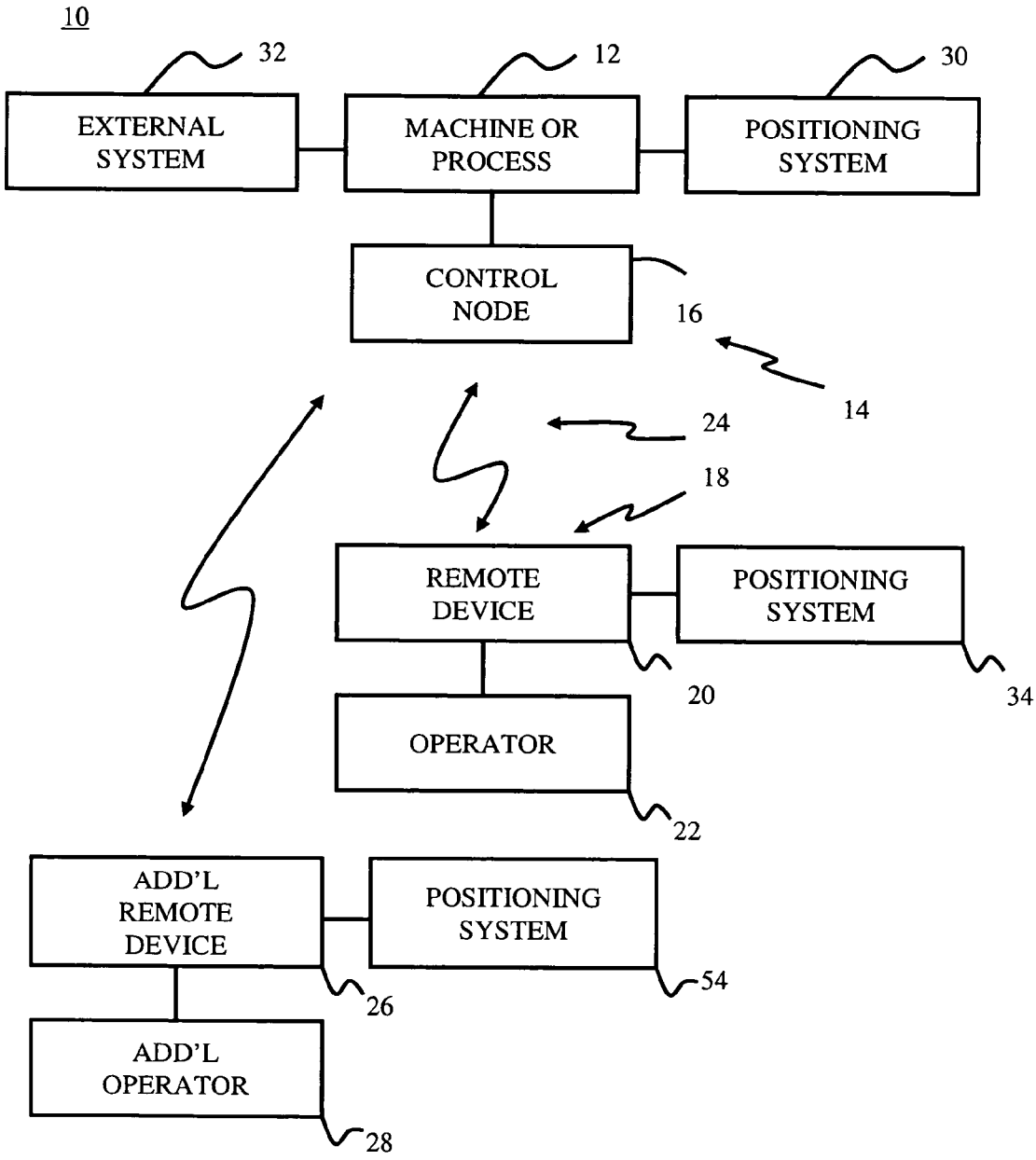
FIG. 1 is a block diagram of a system for controlling operation of a machine or process, according to an embodiment of the present invention.

With specific reference to FIG. 1, the system 10 includes a control point 14 located with respect to machine or process 12. In one embodiment, the control point 14 may include a controller or control node 16 for the machine or process 12. The system 10 may further control additional control nodes 16. The controller 16 may include a computer or microprocessor based controller for controlling operation of the machine or process 12. Alternatively, the controller 16 may include a remotely activated switch for enabling/disabling operation of the machine or process 12.

The system 10 further includes a remote node 18, 26 located with respect to an operator 22, 28 of the machine or process 12. In one aspect of the present invention, the remote node 18, 26 detects a predetermined condition of the operator 22, 28 and responsively delivers a fault signal to the control point 14 through a wireless communications channel In one embodiment, the remote node 18, 26 generates the signal at periodic times. In another embodiment, the remote nodes generates the signal in response to receiving a request signal from the control point.

In one embodiment, the wireless communications channel 24 uses the IEEE 802.11 standard, e.g., 802.11b or 802.11g. However, it should be noted that the wireless communications channel 24 may use any suitable and reliable communications channel, such as a short range radio link (e.g., a link using the technology known as "Blue Tooth").

The system 10 may also include additional remote nodes 26 with associated other operators 28. For example, each person on a large ship could be outfitted with their own remote node 18, 26 for tracking or reporting one or more related conditions (see below). Each additional remote node 26 may have an associated positioning system 54.

The remote node 18, 26 may be used to track or record any number of conditions of the operator 22, 28. For example, the remote node 18, 26 may be outfitted with one or more sensors (not shown) for monitoring a health condition, e.g., blood pressure, heart rate, etc . . . , of the operator 22, 28. The monitored health condition may be used to determine the consciousness of the operator 22, 28, e.g., if the operator 22, 28 has fallen asleep or has otherwise lost consciousness.

The remote node 18, 26 may also be outfitted with a positioning system, such as a global positioning system (GPS) for detecting the position of the operator 22, 28. The remote node 18, 26 may thus be used to detect the presence or absence of the operator 22, 28 relative to a predetermined location or within a predetermined geographic area.

In one embodiment, the controller 16 may generate an alarm, e.g., an audio and/or visual signal, in response to the signal. For example, the controller 16 may generate the alarm when a monitored condition, such as a health indicator or condition, falls outside predetermined thresholds. Or the controller 16 may generate an alarm when the operator 22, 28 leaves or enters a predetermined area, e.g., defined by a predetermined or programmable distance from the control point 14. For example, if a person located aboard a ship falls overboard, the controller 16 by monitoring their position could determine that the person had fallen over and generate an alarm.

In one embodiment, the control 16 allows the machine or process 12 to be started in response to receiving the signal. For example, if an operator 22, 28 is in predetermined position relative to the machine 12, such as a vehicle, than the operator 22, 28 may start the vehicle.

In one embodiment, the remote node 18, 26 is embodied in a remote device 20 which may be worn or carried by the operator 22, 28 and may include, but is not limited to, a watch, pager, mobile telephone, pendant, vest, and uniform.

In one embodiment, the remote device 20 may be used to provide remote control of the machine or process 12. For example, the remote device 20 may be used to start or stop the machine or process 12.

In another aspect of the present invention, the system 10 further includes an external system 32. The external system 32 may be located at a remote location. The system 10 may communication to the external system 32 for reporting and/or monitoring the condition of the operator 22, 28.

In another aspect of the present invention, the system 10 may also include a position locating system 30 coupled to the controller 16 for determining a position of the machine or process 12 when the signal is received and generating a position signal in response to the determined position.

Figure 2:
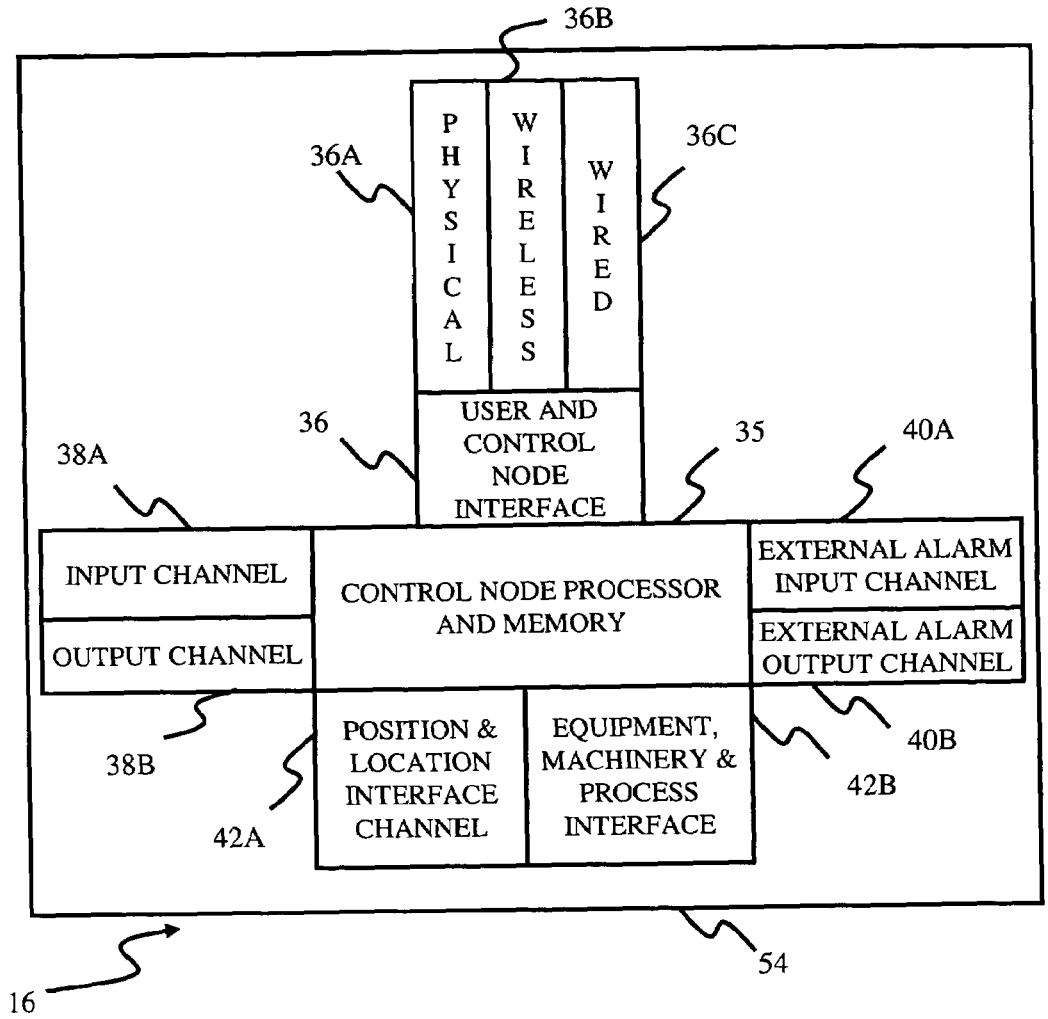
FIG. 2 is a block diagram of a control node of the system of FIG. 1, according to an embodiment of the present invention; and, FIG. 3 is a block diagram of a remote node, according to an embodiment of the present invention.

With reference FIG. 2, a block diagram of an exemplary control node 16 is shown. The exemplary control node 16 is comprised of a processor and memory 35, a user and remote node interface 36, a plurality of physical, wired and wireless interface units 36A, 36B, 36C, an input and output channel 38A,38B, an external alarm input and output channel 40A, 40B, a position and location interface channel 42A and an equipment, machinery and process interface 42B.

The processor 35 runs a program, which intercommunicates with the I/O channels 36A, 36B, 36C, the user and remote node interface 38A, 38B, the position and location interface channels 42A and the equipment, machinery and process interface 42B. The processor 35 includes memory for the storage of programs and data necessary for its operation. The processor 35 also contains a clock and calendar function, which can be maintained internally by the processor or the position and location interface channel 42A, if present.

The program supports a configuration process, which permits the owner/operator 22, 28 to define the control and alarm properties of the system 10. The first step in this process is, but is not limited to, identification of the central control nodes 16 present and their associated remote nodes 20, 26. A configuration interface is used to identify all the operator sensors (see below) associated with it and the permits each remote node 18, 26 individually to be configured to an active versus inactive status. In addition, the configuration interface permits each node to be individually configured as to what actions the control or remote node 18, 26 is to take should that node fall outside the normal zone of coverage and trigger an alarm condition. The normal zone of coverage is then defined permitting the zone to be increased or diminished depending on the application or process being defined. For large applications, repeater control nodes can be added to the system 10, which permit the system 10 to operate over a large geographic area with each control node intercommunicating to report the status of remote nodes 18, 26 in its proximity. If multiple control nodes 16 in a large installation have the same remote node 18, 26 within its proximity, the redundant contact points may be purged using the highest signal strength reading received from the remote node 18, 26 as the priority setting criteria. All configuration processing is done through the control node interface 36 and can be accomplished with a plurality of devices each having a means to input data, display information and interface with the control node processor and memory 35 and control program.

All communications between the control node processor and the remote nodes 18, 26 is done through the input and output channels 38A, 38B. This communications channel may be RF in nature but would not be limited to this means and could be substituted by any reliable and suitable communications channel medium that meets the cost and quality measure of the application. All communications between the channels 38A, 38B and the remote nodes 18, 26 contain unique identification indicators which permit traffic between a remote node and an operator sensor to be isolated from nodes or sensors points of other systems in close proximity. As a result, control node 16 will only recognize and interface with remote nodes 18, 26 and repeater nodes within its defined group; and remote nodes 18, 26, if operating in a two way mode, will only recognize and interface with control nodes 16 and repeater nodes within its defined group. Because the remote node 18, 26 is capable of monitoring and reporting a plurality of conditions regarding the person, animal or object to which it is attached, the I/O channel 38A, 38B may be designed to handle variable and fixed length messages. The control node processor and memory 35 are similarly configured to accept, process, report and record these messages in accordance with the configuration definitions entered into the system 10 at the time of configuration as well as performing any defined actions or alarms that are necessary based on the message type or content.

The control node 16 may be equipped with an optional interface, which permits it to intercommunicate with any industry standard or customized Position and Location Interface Channel or Device. Many GPS devices available on the market today like those manufactured by Garmin, Raytheon, Trimble or Northstar provide an industry standard NEMA communication interface which interconnect over a wireless, wired or fiber optic communications channel. While the preferred channel is a shielded two wire interconnect the interface of the system is modular and will accept RF, Infrared or any other suitable and reliable communications channel that meets the needs of the application. In the case of a GPS system or Loran system, communications is accomplished using NEMA 180 or NEMA 183 communications protocols. Other more sophisticated or custom position and location systems can be interfaced to the system permitting it to have immediate and accurate geographic location data available at all times. As an additional advantage, most position or location systems also provide as a product of their output a time and date message, which is usually associated with an extremely accurate atomic clock. Time and date data, when available, will be used by the control node processor 35 and the control application software, to time stamp and record event and location messages into the memory. If so equipped, the control node processor 35 and control application software will pass alarm messages to the position and location interface channel 42A to be used by a plurality of navigation and other processors, which share the communication channel to enhance the function and features of the system 16 including emergency locator beacons and signaling devices mentioned earlier.

One purpose of the system 10 is to activate an alarm if a remote node 18, 26 passes outside of the normal proximity limits of the system 10 or if so equipped, an operator health sensor 50 triggers an alarm condition. When these or any of a plurality of conditions defined in the configuration process are activated, the control application software will use any of a plurality of communications channels, lights, horns and other methods to immediately report and record an alarm event and make its existence known to all systems associated with it or having a need to know. In addition, the control application software will utilize the configuration definition associated with the remote node 18, 26 and the equipment, machinery and process interface 42B to perform any termination, neutralization or corrective actions as instructed or defined in the configuration definition procedure. Depending on the operation being managed, any number of relays, switches, pneumatic, hydraulic or other control or management device or system will be instructed or triggered to perform specific control procedures as specified in the control node configuration process. It should be noted that each remote node 18, 26 can have a unique configuration command process associated with it. In the case where multiple remote nodes 18, 26 exist and multiple alarms are triggered by these points either simultaneously or in a serial fashion, the control node processor 35 will use a priority scheme defined in the configuration process to prioritize and initiate the applicable control procedures associated with each alarm condition until complete.

Due to its nature of being a proximity sensing and control system 10 it also stands to reason that process can be configured so that it will not initiate unless the remote nodes 18, 26 are within the configured normal proximity limits before a process can be initiate. As a result, the system 10 can also act as a theft deterrent system in that no process under its control can be initiated unless an authorized and properly configured remote node 18, 26 is present. As mentioned earlier, if so equipped, the system 10 can be fitted with an override switch mechanism permitting the total bypass of the control node processor 35. If equipped with position and location interface channel communications, when an alarm is initiated, the system 10 will track and report the location of the initial alarm and all subsequent changes in course, speed, altitude and direction until the alarm is either cancelled or extinguished. This function is essential in processes like a man overboard emergency, especially at night to ensure the quick and accurate recovery of the missing person, animal or object.

The external alarm input and output channel 40A, 40B of the control node 16 permits the control node 16 processor to intercommunicate with outside monitoring services and networks, providing a broader notification of alarm conditions. As an example, outside monitoring services and networks in the marine industry include any number of satellites or land station based monitoring systems that scan specific frequencies for distress messages normally generated by EPIRB systems or beacons. Coast Guard facilities also continually monitor channel 16 of the marine VHF frequency for emergency or distress calls or signals and most systems have been adapted now to transmit and receive either analog voice of digital data signals. These two example provide a small sample of the network and monitoring facilities that the control node processor 35 through the external alarm input and output channels 40A, 40B has access to for reporting an alarm condition. In addition, satellite based communications networks, cellular phone systems and certain microwave and other suitable networks that meet the needs of the particular configuration being monitored can be used successfully as long as they are reliable and provide adequate coverage. While most alarm reporting systems are typically one way in nature, the external alarm input and output channels 40A, 40B are designed to operate in either a one way or two way capacity, giving the ability of an outside monitoring and control system using the external alarm input and output channel 40A, 40B to monitor and if so desired to control the equipment, machinery or process if so configured in the configuration process using the external alarm input and output channels 40A, 40B, the control node processor 35 and equipment, machinery and process interfaces 42B. As a result, the central control node 16 will work with both public, government operated and managed as well as private monitoring and management service providers over either public or private networks to improve the safety and continued operation and control of remotely located equipment, machinery and processes 12.

Figure 3:
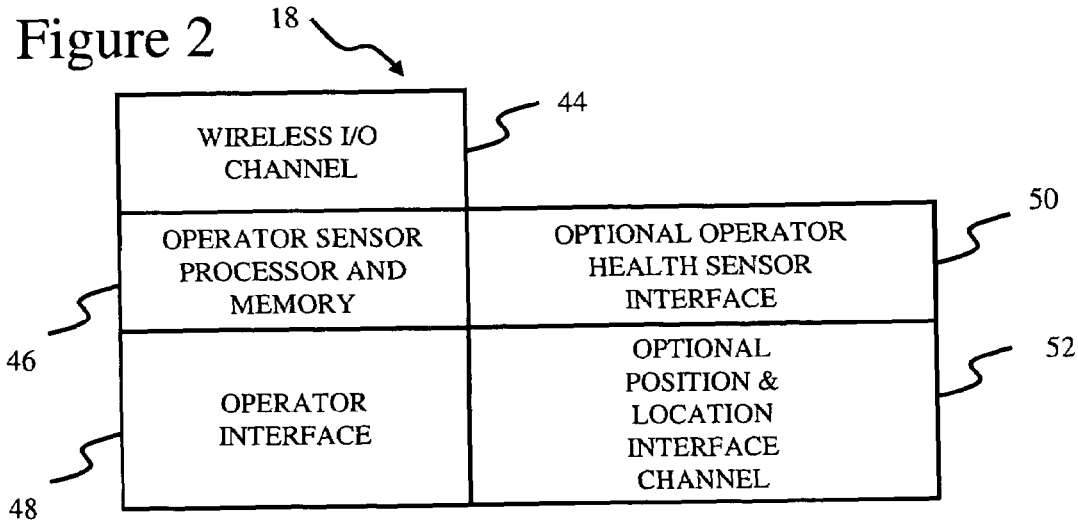

The remote nodes 18, 26, as mentioned earlier, can take many forms. This flexibility permits the remote node 18, 26 to be designed into the process that is to be monitored and controlled to permit the greatest level of flexibility and ease of use. With specific reference to FIG. 3, because the base unit of the remote node 18, 26 in its basic form is very small, consisting of a wireless I/O channel 44, sensor processor and memory 46 and an operator interface 48 the remote node 18, 26 can take the form of a watch, pager, cell phone or pennant that can be worn around the neck of the operator 22, 28, animal or object that is being monitored. The addition of an optional operator health sensor interface 50 and/or optional position and location interface channel 52 may require additional sensors and therefore a different configuration or design.

The remote node 18, 26, due to its mobile form, may depend on a portable power source or may be passive in nature depending on the application. If powered, the power source will normally take the form of a rechargeable battery, series of batteries, a long life lithium cell or any other power source that will meet the needs of the particular application including but not limited to motion generators or photovoltaic cells. The remote node 18, 26 may be designed to monitor and report on the status of the onboard power supply if so equipped, and will perform a soft alarm, indicating that the power supply has reached a point requiring recharging or replacement. The length of lead time for triggering this alarm and the actions to be taken by the control node 16 are all part of the configuration process performed for each individual remote node 18, 26. In addition to performing the above alarm function at the control node 16, the alarm condition can be activated at the remote node 18, 26 as well and could, as an example, take the form of a visual, audible or physical vibration.

The remote node 18, 26 is designed to intercommunicate with the control node 16 over the any suitable I/O channel. The sensor processor and memory 46 are configured to meet the need of the particular application as well as meet the power consumption if powered, storage and interconnection needs to support the process to be controlled. The operator interface 48, in the basic configuration, for example, consists of processor and memory in an appropriate enclosure. The user interface would optionally consist of at least one contactor or sensor based means to respond to prompts or alarms and a display means. The above description is provided for illustrative purposes only and is not intended to limit the design, capabilities or features of the remote node 18, 26.

Other features of the remote node 18, 26 include its ability to perform routine and continuous operator Health and Consciousness tests and to update the control node 16 as conditions change. As an example, the remote node 18, 26 can be configured to produce an audible or physical vibration on regular intervals, which must be reset by the operator 22, 28 using an appropriate method or response. The elapse time between these triggered response events is defined and setup at the time the remote node 18, 26 is configured. In addition, the action to be taken by the control node 16, if the operator does not respond in the timeframe defined, is also set at this time. Other sensors to test heart rate, blood pressure rate of respiration and other health and consciousness factors mentioned earlier may also be included in the operator health sensor interface 50 as needed or deemed necessary depending on the application. It should be noted at this point that the term Health Sensor is not limited to purely physical health of a person or animal by this description. Health of objects is also included in this definition temperatures, pressures, moisture content or any state that can be measured or monitored and reported by a sensor are also to be considered as applying to this remote node 18, 26.

In summary, the invention while described here in primarily a maritime application would not be limited to such uses. The remote node 18,26 would equally apply to Utility Field Crew Workers who work in high voltage or dangerous environments alone. It would also apply to miners, people in the oil and gas exploration business, especially those operating on offshore oil and gas platforms. It could be applied in a mobile version for school field trips or in any like situation where a group is traveling together and the need to monitor and ensure all parties are present at all times generates a level or safety and security to warrant its use. Because it works with both humans, animals and objects, it could be applied to inventory management applications for objects where justified as well as livestock management, tracking and control needs. Any application that requires the monitoring, tracking and proximity management is a potential beneficiary of the invention.

INDUSTRIAL APPLICABILITY

Dead Man switches today are primarily mechanical devices, which require the operator of a piece of machinery or equipment to maintain some physical contact with or immediate presence at the controlling point. The invention proposes the use of a non-physical (NP) tether, one end at the operational control point for the machinery or equipment and the other with the designated operator. The primary intent of this invention would be to apply it to marine applications to improve the safe operation of vessels and protect the life of crewmembers but is not limited to his application and can be applied to any condition in which a dead man switch would improve safe and prudent operation of any equipment, machinery or process or in which a presence or health sensing and monitoring system and function is needed to improve safety, security and continuity of a process, a system, an object or a life form. Like its tethered mechanical forerunner, the NP link in its basic form would permit the normal operation of the machinery or equipment as long as the operator remained within specified proximity of the control point. Depending on NP tether requirements, the length of the tether (the PXLink or Proximity Link length) can be increased or decreased to permit the operator freedom of movement without sacrificing safety or functionality. If for some reason, the control point does not detect the other end of its NP tether, it would immediately alarm and if so configured, interrupt the operation of the equipment, machinery or process under its control causing it to stop or assume a neutral position. Once the operator's end of the NP tether is detected by the control point end, the restarting of the equipment, machinery or process would be permitted. As an additional feature, the NP link could provide an additional security feature to protect equipment and machinery from theft or other misuse. When installed it will be necessary for the operators end to be present in order to start or operate the equipment or the process under its control. An enhanced version of the NP link would include a health monitoring and consciousness-sensing capability to issue an alarm if the health of the operator becomes questionable or the attention of the operator is interrupted causing a hazardous situation. Health matters would include but are not limited to heart attack, respiration and heart rate, blood sugar level, blood pressure, eye and eye lid motion and brain wave monitoring while the consciousness-sensing includes but is not limited to falling asleep, trauma and shock detection.

The NP link between the control point and the operator can take the form of any number of non-physical one or two way communication channels and mediums such as infrared, RF or any other suitable and reliable non-physical spectrum link depending on the application. The preferred communications channel is RF.

As mentioned above, proximity to the control point may not be the only criteria to maintain safe operation of a piece of machinery or equipment, the operators end could optionally be enhanced to include a plurality of sensors to detect at a minimum a heart beat or pulse, consciousness, and other vital signs mentioned above. It might also be equip with a means to allow the operator to force the shutdown or neutralization of the machinery or equipment. In use, if any of these optionally equip sensing devices detect an alarm condition on the operators end, a fault signal status would be issued to the control point end immediately. When that happens, either an immediate shutdown or neutralization of the machinery, equipment or process would occur or optionally a series of corrective actions would initiate in an attempt to reverse the perceived fault. If either a fault reversal or override signals are not receive by the control point within a specified time frame, the machinery or equipment or process would shutdown or neutralize based on the installation configuration selected and designed. It is important to note at this point that a single control point may be configured to require multiple NP links to be present to operate. This would be the case where multiple people are required to be present for the safe operation of the equipment, machinery or process. This configuration process is dynamic in that the system can be reconfigured at any time to accommodate different conditions and needs. It is also important to note that the control point can be configured to simply alarm but not interrupt the equipment, machinery or process if one or more or the NP link devices fails to report. As a result, a pure alarm condition configuration is possible which will not interrupt the equipment, machinery or process immediately. Depending on the installation and configuration, interruption of the equipment, machinery or process may never occur, may occur if the alarm condition continues for some preset time period or immediately. Communicating with outside networks, alarm and notification systems and reporting of positions and conditions as mentioned later in this disclosure are also configurable depending on the specific needs of the condition being managed and monitored.

The operators end of the tether could take many forms. In its simplest form, it could be worn as a watch, pager, cell phone or placed around the neck as a pendent. In a more complex adaptation, it might be incorporated into a vest or uniform worn by the operator. It can be configured with a display means, a sound emitting means, a vibration means, switches, buttons and lights. It can be a simple transmit only device or a fully functional two way communicating device. It can be powered or passive in nature. No matter what its configuration, the operators end will be required to transmit on request, at designated intervals or both, data to the control point in order to maintain the uninterrupted operation of the controlled equipment, machinery or process if so configured. The frequency of the transmissions, amount data transmitted and tether length, are determined by the application on a case-by-case basis. In case of a failure or malfunction of either end of the tether, an override capability can be optionally installed. While this type of bypass negates the safety features of the NP link, it may be necessary for any number of reasons. If the bypass mechanism is installed, a security seal should be utilized that would have to be removed to active it.

An additional feature of the system is its ability to interface with a communications system or network as well as interface with or have fully integrated a position location system such as a GPS positioning system or EPIRB emergency beaconing system or other appropriate alarm notification system. By interfacing with a communications system and positioning or alarm system, the NP link would not only be capable of halting or neutralizing the machinery, equipment or process over which it has control but also initiate a broader alarm notification process including transmission of an alarm message including the exact location of the alarm condition. This process permits rescue and recovery procedures to be conducted much faster and easier in response to an alarm condition greatly improving the potential to limit the scope of the emergency and limit the damage associated with it including the loss of life. As such, the control point and remote node can be optionally equipped with location and positioning detection circuits utilizing GPS or any other suitable positioning detection means as well as one or two way communication channels over which to transmit that data to the control point or any monitoring system used to detect emergency signals or both. The control point can also be duplicated in its monitoring and alarm function and incorporated into a recovery beacon, like an EPIRB floating beacon, life boat or raft beacon or any other suitable distress notification safety equipment in marine applications, so that if the vessel is lost, the last known position of each crew member will be retained and transmitted along with the position of the emergency beacon. This multi-control point capability increased the overall effectiveness of the system in marine applications and ensures a higher potential of a fast recovery and reduced loss of life. The level of integration into a reporting and alarm system will depend greatly on the design and needs of the process being secured.

A practical example of how such a device might be used is provided here to illustrate its usefulness and practicality. Recreational fishing boats in the Gulf of Mexico often have to run 25 miles off shore to find suitable water depth and fish. As a result, many boat owners have installed autopilots to take some of the boredom out of the trip. It is quite common for captains of such boats to busy themselves with preparing lines, poles and baits while underway. To perform these tasks, the captain if not operating alone, will ask someone to keep an eye out ahead and while he or she tends to preparatory matters. Recently, a captain on such a trip accidentally fell overboard and was forced to tread water for 20 hours before being rescued. Worst yet, it took over 3 days to locate his boat, which had his dog on it. While this incident did not have a tragic ending, it very easily could have. The captain could have drowned and the boat could have collided with another boat potentially resulting in additional deaths. If a system such as the NP link had been installed on this boat and the captain had used it properly, the boat would have come to a stop once an NP alarm condition was triggered reducing the severity of the mishap. Other examples of how the system might be used in a marine environment include but are not limited to use on military ships where large numbers of crew are present and the loss of a single crewmember might go unnoticed for hours. The use by single-handed boaters should they fall overboard or become physically disabled. The use by crewed boats on long passages where a crewmember might fall overboard during the night and go undetected for hours. Another application would be to tract crew on off shore oil platforms. In any of these situations where there is a moving vessel, the pure alarming capability, reporting of the position of the alarm as well as the interruption of the forward progress of the vessel would all be available through a plurality of configurations based on the application.

Obviously, many modifications and variations of the present invention are possible in light of the above teachings. The invention may be practiced otherwise than as specifically described within the scope of the appended claims.

Element List

10 system
12 machine or process
14 control point
16 control node or controller
18 remote node
20 remote device
22 operator
24 wireless communications channel
26 additional remote nodes
28 additional operators
30 positioning system
32 external systems
34 machine or process positioning system
35 processor and memory
36 a user and remote node interface
36A physical interface unit
36B wired interface units
36C wireless interface unit
38A input channel
38B output channel
40A external alarm input channel
40B external alarm output channel
42A position and location interface channel
42B equipment, machinery and process interface
44 Wireless I/O Channel
46 Operator Sensor Processor and Memory
48 Operator Interface

50 Optional Operator Health Sensor Interface
52 Position and Location Interface Channel
54 machine or process positioning system for additional node

What is claimed is:

1. A system, comprising:

a controller for controlling operation of one of a machine or process;

a control point coupled to the controller and being located with respect to the one of a machine and process; and, a remote node located with respect to an item associated with one of a machine and process for detecting a predetermined condition of the item and automatically delivering a fault signal to the control point through a wireless communications channel in response to detecting the predetermined condition of the item, the controller for controlling operation of the one of the machine or process as a function of the presence or absence of the fault signal.

2. A system, as set forth in claim 1, wherein the controller generates an alarm in response to the signal.

3. A system, as set forth in claim 1, the control point for detecting a presence of the remote node.

4. A system, as set forth in claim 3, the predetermined condition being an absence of the remote node.

5. A system, as set forth in claim 4, where the absence of the remote node is defined by a predetermined distance.

6. A system, as set forth in claim 5, where the predetermined distance is programmable.

7. A system, as set forth in claim 4, the predetermined condition being the presence of the remote node.

8. A system, as set forth in claim 7, wherein the controller allows the one of a machine and process to be started in response to receiving the signal.

9. A system, as set forth in claim 1, wherein the item is one of a person, animal or object.

10. A system, as set forth in claim 1, wherein the remote node is embedded in a device worn or carried or attached to the item.

11. A system, as set forth in claim 10, the device for communicating with an external system, for monitoring a condition of the item, and for reporting the condition to the external system.

12. A system, as set forth in claim 11, the condition including at least one of a health indicator and a position.

13. A system, as set forth in claim 1, where the remote node generates the signal at periodic times.

14. A system, as set forth in claim 1, wherein the remote nodes generates the signal in response to receiving a request signal from the control point.

15. A system, as set forth in claim 14, further comprising a position locating system coupled to the controller for determining a position of the one of a machine and process when the signal is received.

16. A system, as set forth in claim 15, wherein the controller generates a position signal in response to the determined position.

17. A system, as set forth in claim 1, further comprising a position locating system for determining a position of the item.

18. A system, as set forth in claim 17, the controller for generating an alarm in response to the signal, the alarm including the position of the item.

19. A system, as set forth in claim 1, further comprising a position locating system for determining a position of the remote node.

20. A system, as set forth in claim 19, the controller for generating an alarm in response to the signal, the alarm including the position of the remote node.

21. A system, as set forth in claim 20, wherein the position locating system includes a device associated with the item.

22. A system, as set forth in claim 1, the remote node communicating with an external system.

23. A system, as set forth in claim 22, the external system comprising at least one of a monitoring system and reporting system.

24. A system, as set forth in claim 1, the control point being embodied in a recovery beacon.

25. A system, as set forth in claim 24, the system being utilized in a marine application, the recovery beacon being floatable.

26. A system, as set forth in claim 24, the recovery beacon being one of a floatable beacon, a life boat beacon or a raft beacon.

27. A system, as set forth in claim 24, further comprising a position locating system for determining a position of one of the remote node and the item, the remote node for transmitting the position to the recovery beacon, the recovery beacon for storing a last known position as a function of the transmitted position.

28. A system, as set forth in claim 27, the recovery beacon for broadcasting the last known position.

29. A system, as set forth in claim 1, including at least one repeater node for receiving the fault signal and repeating the fault signal through the wireless communications channel.

30. A system, as set forth in claim 29, wherein the control node, at least one repeater node, and remote node are spaced apart to cover a geographic area.

31. A system, as set forth in claim 29, wherein the control point receives signals from one or more of the remote node and the at least one repeater node and utilizes the strongest signal.

32. A system, comprising:

a first controller for controlling operation of a first machine and/or process;

a second controller for controlling operation of a second machine and/or process;

a control point coupled to the first controller and the second controller;

a first remote node being located with respect to a first item associated with the first machine and/or process for detecting a predetermined condition of the first item and automatically delivering a first fault signal to the control point through a wireless communications channel in response to detecting the predetermined condition of the item, the first controller for controlling operation of the first machine and/or process as a function of the presence or absence of the first fault signal; and, a second remote node being located with respect to a second item associated with the second machine and/or process for detecting a predetermined condition of the second item and automatically delivering a second fault signal to the control point through the wireless communications channel in response to detecting the predetermined condition of the item, the second controller for controlling operation of the second machine and/or process as a function of the presence or absence of the second fault signal.

33. A system, as set forth in claim 32, wherein the first and second controller are the same device.

34. A system, comprising:

a controller for controlling operation of one of a machine or process;

a control point coupled to the controller and being located with respect to the one of a machine and process;

a repeater node wirelessly coupled to the control point; and, a remote node located with respect to an item associated with one of a machine and process for detecting a predetermined condition of the item and automatically delivering a fault signal to the control point through the repeater node using a wireless communications channel in response to detecting the predetermined condition of the item, the controller for controlling operation of the one of the machine or process as a function of the presence or absence of the fault signal.

35. A system, comprising:

a first controller for controlling operation of a first machine and/or process;

a second controller for controlling operation of a second machine and/or process;

a first control point coupled to the first controller;

a second control point coupled to the second controller;

a first remote node being located with respect to a first item associated with the first machine and/or process for detecting a predetermined condition of the first item and automatically delivering a first fault signal to the control point through a wireless communications channel in response to detecting the predetermined condition of the item, the first controller for controlling operation of the first machine and/or process as a function of the presence or absence of the first fault signal; and, a second remote node being located with respect to a second item associated with the second machine and/or process for detecting a predetermined condition of the second item and automatically delivering a second fault signal to the control point through the wireless communications channel in response to detecting the predetermined condition of the item, the first controller for controlling operation of the first machine and/or process as a function of the presence or absence of the first fault signal, wherein all signals between the remote nodes and the respective controllers include a unique identification indicator, each controller only responding to signals having a corresponding unique identification indicator.

36. A system, as set forth in claim 35, including at least one first repeater node for receiving the first fault signal and repeating the first fault signal through the wireless communications channel and including at least one second repeater node for receiving the second fault signal and repeating the second fault signal through the wireless communications channel.

* * * * *